US011684841B2

(12) United States Patent
Nelson

(10) Patent No.: US 11,684,841 B2
(45) **Date of Patent: *Jun. 27, 2023**

(54) ATHLETIC MASK AND HELMET

(71) Applicant: Keith Nelson, Omaha, NE (US)

(72) Inventor: Keith Nelson, Omaha, NE (US)

( * ) Notice: Subject to any disclaimer, the term of this patent is extended or adjusted under 35 U.S.C. 154(b) by 182 days.

This patent is subject to a terminal disclaimer.

(21) Appl. No.: 17/140,345

(22) Filed: Jan. 4, 2021

(65) Prior Publication Data

US 2021/0197063 A1 Jul. 1, 2021

Related U.S. Application Data

(63) Continuation of application No. 15/882,151, filed on Jan. 29, 2018, now Pat. No. 10,881,942.

(60) Provisional application No. 62/451,957, filed on Jan. 30, 2017.

(51) Int. Cl.

| | |
|---|---|
| ***A63B 71/10*** | (2006.01) |
| ***A41D 13/11*** | (2006.01) |
| ***A42B 3/20*** | (2006.01) |
| ***A42B 3/22*** | (2006.01) |

(52) U.S. Cl.

CPC ..... *A63B 71/10* (2013.01); *A41D 13/1107* (2013.01); *A42B 3/20* (2013.01); *A41D 13/1184* (2013.01); *A42B 3/225* (2013.01)

(58) Field of Classification Search

CPC .... A61F 9/02; A61F 9/04; A61F 9/045; A61F 9/06; A42B 1/004; A42B 3/18; A42B 3/222; A42B 3/20; A42B 3/227; A63B 71/10; A63B 71/08; A45D 44/12;

(Continued)

(56) References Cited

U.S. PATENT DOCUMENTS 2,625,684 A * 1/1953 Magnusson ..... A61F 9/02 2/9
3,206,760 A * 9/1965 Santala ..... A45D 44/12 128/202.16

(Continued)

FOREIGN PATENT DOCUMENTS

WO WO-0024278 A1 5/2000

OTHER PUBLICATIONS

"U.S. Appl. No. 15/882,151, Final Office Action dated Jun. 10, 2020", 8 pgs.

(Continued)

*Primary Examiner* — Katherine M Moran
(74) *Attorney, Agent, or Firm* — Schwegman Lundberg & Woessner, P.A.

(57) ABSTRACT

Novel and advantageous masks and helmets to protect an athlete's head and face from impacts and injuries. In particular, the present disclosure relates to novel and advantageous masks and helmets to help protect a baseball or softball catcher's face and head from concussive forces of an incoming ball strike. A mask of the present disclosure may be coupled to a helmet, or may be configured for use without a helmet in some embodiments. The mask may provide a generally cone-shaped structure in front of a wearer's face, so as to provide an angled surface for contact with an incoming ball. Additionally, a shock absorbing material may be provided at an interface between the helmet and mask to reduce and distribute force transfer between the mask and the helmet.

20 Claims, 14 Drawing Sheets

(58) Field of Classification Search
CPC .. A45D 44/002; A45D 40/30; A41D 13/1107; A41D 13/1184
See application file for complete search history.

(56) References Cited

U.S. PATENT DOCUMENTS

| | | | | | |
|---|---|---|---|---|---|
| 3,241,155 | A * | 3/1966 | Phillips | A45D 44/12 | 2/9 |
| 3,261,027 | A | 7/1966 | Lambert | | |
| 3,317,921 | A * | 5/1967 | Zarzour | A45D 44/12 | 2/9 |
| 3,488,772 | A * | 1/1970 | Sturm | A45D 44/12 | 2/9 |
| 4,271,537 | A | 6/1981 | Bowlus et al. | | |
| 5,263,204 | A * | 11/1993 | Butsch | A42B 3/326 | 2/9 |
| 7,802,572 | B2 * | 9/2010 | Hahne | A41D 13/1192 | 128/857 |
| 10,881,942 | B2 * | 1/2021 | Nelson | A42B 3/20 | |
| 2009/0031484 | A1 | 2/2009 | Broersma et al. | | |
| 2009/0126063 | A1 * | 5/2009 | Brown | A42B 3/20 | 2/15 |
| 2010/0122402 | A1 | 5/2010 | Tipp | | |
| 2014/0196199 | A1 | 7/2014 | Huffman | | |
| 2015/0082521 | A1 | 3/2015 | Hassan | | |

OTHER PUBLICATIONS

"U.S. Appl. No. 15/882,151, Non Final Office Action dated Sep. 3, 2019", 11 pgs.
"U.S. Appl. No. 15/882,151, Notice of Allowance dated Sep. 2, 2020", 7 pgs.
"U.S. Appl. No. 15/882,151, Response filed Mar. 3, 2020 to Non Final Office Action dated Sep. 3, 2019", 11 pgs.
"U.S. Appl. No. 15/882,151, Response filed Aug. 19, 2020 to Final Office Action dated Jun. 10, 2020", 10 pgs.

* cited by examiner

ATHLETIC MASK AND HELMET

CROSS-REFERENCE TO RELATED APPLICATIONS

The present application is a continuation of U.S. patent application Ser. No. 15/882,151, titled "Athletic Mask and Helmet," filed Jan. 28, 2018, which claims priority to Provisional Application No. 62/451,957, titled "Stealth Catcher's Mask," filed Jan. 30, 2017, each of which the content is hereby incorporated by reference herein in its entirety.

FIELD OF THE INVENTION

The present disclosure relates to novel and advantageous sporting equipment. Particularly, the present disclosure relates to novel and advantageous headwear for protecting a wearer's face and head. More particularly, the present disclosure relates to novel and advantageous baseball and softball catchers' masks and helmets

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In baseball and softball, a catcher crouches behind the batter to receive the ball from the pitcher. The catcher often wears gear and padding for protection in case the catcher is hit by the ball. In some cases, the catcher wears a helmet and/or face mask to protect the catcher's head and/or face from, for example, a foul tip. Conventional catchers' masks often have metal or wire cage that extends over and in front of the wearer's face. While such masks may help to prevent contusions or fractures to the head or face, the catcher may still suffer injury if the ball strikes the mask directly, as the strike may transfer a relatively large percentage of force from the ball to the mask. In some cases, a direct impact from a ball to the catcher's mask or helmet can even result in a concussion.

Thus, there is a need in the art for a face mask that helps to protect a wearer's face and/or head from injury from an incoming ball or other object. In particular, there is a need in the art for a face mask that helps to direct force from a ball or other object away from the wearer's face and/or head.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to an athletic headwear device having a helmet and a mask for coupling to the helmet. The mask may have an edge defining an opening configured to receive a wearer's face, a curved sidewall extending at an angle from the opening to a tip, and a coupling mechanism for coupling the mask to the helmet. The coupling mechanism may include a strap extending from a first side of the mask to a second side of the mask and configured to extend around the helmet. The helmet may include a groove configured to receive the strap. In some embodiments, the headwear may have a shock absorbing material arranged between the mask and the helmet. The helmet may have a channel for receiving the edge of the mask, and the shock absorbing material may be arranged within the channel. The tip of the mask may be configured to be arranged between 5 and 15 inches in front of the wearer's face, and may be configured to align with a point on the wearer's face between the wearer's nose and chin. The tip of the mask may have an opening in some embodiments. The sidewall may include a transparent material. Moreover, in some embodiments, the mask may include a lens portion and a cage portion. The cage portion may define a lower portion of the mask, and may include a plurality of bars arranged in a grid. The lens portion may have a thickened sidewall at the interface between the lens portion and the cage portion. In some embodiments, at least a portion of the plurality of bars may have one or more dados for coupling to the lens portion.

The present disclosure, in one or more embodiments, additionally relates to an athletic mask configured for coupling to a helmet. The mask may have an edge defining an opening configured to receive a wearer's face, a curved sidewall extending at an angle from the opening to a tip, and a coupling mechanism for coupling the mask to a helmet. The sidewall may extend from the edge to the tip of the mask at an angle of between approximately 20 degrees and approximately 70 degrees. In some embodiments, the sidewall may include a transparent polycarbonate material. The mask may have a forehead portion configured to extend over the wearer's forehead and a chin portion configured to extend below the wearer's chin. In some embodiments, the mask may include a lens portion and a cage portion comprising a plurality of bars arranged in a grid. The lens portion may have a thickened sidewall at the interface between the lens portion and the cage portion.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous masks and helmets to protect an athlete's head and face from impacts and injuries. In particular, the present disclosure relates to novel and advantageous masks and helmets to help protect a baseball or softball catcher's face and head from concussive forces of an incoming ball strike. However, it is to be appreciated that a helmet and mask of the present disclosure may be worn for other sports, such as but not limited to hockey or cricket. A mask of the present disclosure may be coupled to a helmet, or may be configured for use without a helmet in some embodiments. The mask may provide a generally cone-shaped structure in front of a wearer's face, so as to provide an angled surface for contact with an incoming ball. Additionally, a shock absorbing material may be provided at an interface between the helmet and mask to reduce and distribute force transfer between the mask and the helmet.

Figure 1:
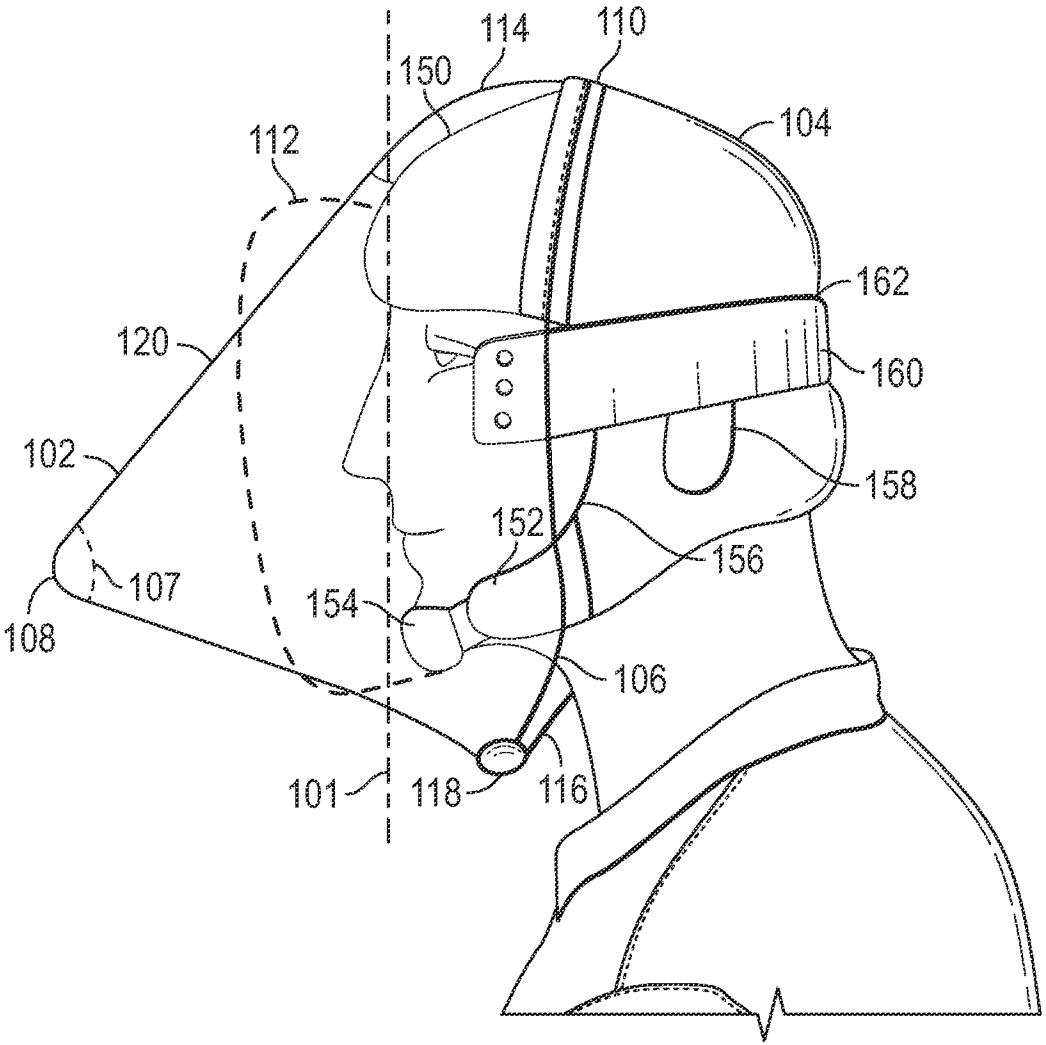
FIG. 1 is a side view of a mask and helmet of the present disclosure, according to one or more embodiments.

Turning now to FIG. 1, a mask 102 and helmet 104 of the present disclosure is shown, according to one or more embodiments. As shown, the mask 102 may generally have a conical shape with an opening 106 configured to receive a wearer's face, and a rounded or pointed tip 108 arranged in front of the wearer's face. The helmet 104 may be shaped and configured to fit over a wearer's head to protect the crown, back, and sides of the wearer's head from a ball strike. Moreover, in some embodiments, a shock absorbing material 110 may be provided between the mask 102 and helmet 104. FIG. 1 also shows an outline of where a conventional mask 112 may be arranged with respect to the wearer's face. As shown, a conventional mask 112 may have a relatively vertical profile in comparison to the conical shape of the mask 102.

In particular, the mask 102 may have a generally conical shape, with a diameter or width decreasing as the mask extends away from a wearer's face. That is the mask 102 may have an opening 106, which may be a largest opening of the mask, configured to be arranged around the wearer's face. A wearer may insert his or her face into the opening 106 of the mask 102, such that the mask may be arranged around the wearer's face to protect the face from ball strikes. The opening 106 may have a generally oval or round shape in some embodiments. For example, the opening 106 may have an oval shape with a largest diameter sized to extend over the wearer's forehead and chin, and a smallest diameter sized to extend over a wearer's cheeks and the sides of a wearer's jaw. Of course, other shapes for the opening 106 are contemplated and can be suitable. In some embodiments, the opening size and shape can even be customized to a particular wearer's face or helmet. From the opening 106, the mask 102 may extend with a gradually decreasing diameter or width toward a point tip 108 in front of the wearer's face. In some embodiments, the tip 108 may be arranged between approximately 5 and 15 inches in front of the wearer's face, or between approximately 6 and 12 inches in front of the wearer's face. In some embodiments, the tip 108 may be generally aligned with the wearer's nose, or just beneath the wearer's nose. However, the tip 108 could be aligned with any other part of the wearer's face. Typically, however, the tip 108 will align with a part of the wearer's face below the eyes so as to not impede the wearer's view through the mask. Also, the tip 108 will typically be aligned with a point of the user's face that falls along a central, vertical, meridian of the user's face. The tip 108 may be rounded or squared in some embodiments. In other embodiments, rather than a point or tip, the conical mask 102 may extend into a second opening 107, smaller than the opening 106 arranged over the wearer's face, which could allow for increased air flow.

To form the cone shape, one or more outer surfaces of the mask 102 may slope toward the tip 108 at an angle, relative to a vertical plane 101 generally aligned with the front of the wearer's face, of between approximately 20 degrees and approximately 70 degrees, or between approximately 30 degrees and approximately 60 degrees, or between approximately 40 degrees and 50 degrees. In some embodiments, an outer surface of the mask 102 may slope toward the tip 108 at an angle, relative to the vertical plane 101, of approximately 45 degrees. In some embodiments, the tip 108 may be centrally arranged, such that upper and lower portions of the mask 102 may slope toward the tip with a same slope. In other embodiments, the tip 108 may be arranged nearer a bottom of the mask 102 than a top of the mask, or nearer the wearer's chin than a top of the wearer's forehead, such that the lower portion of the mask may slope toward the tip 108 at a larger angle than the upper portion of the mask.

In some embodiments, the mask 102 may be configured to generally contour around the wearer's face before sloping toward the tip 108. For example, as shown in FIG. 1, the mask 102 may have a forehead portion 114 and a chin portion 116 configured to contour around the wearer's forehead and chin, respectively. The forehead portion 114 may have a rounded or arced shape. The chin portion 116 may generally be shaped and contoured so as to protect the wearer's chin and/or throat without unreasonably interfering with the wearer's head movements. In some embodiments, the chin portion 116 may have padding 118 on an edge of the mask 102 in case of contact with the user's skin, such as the user's neck. Additionally, other portions of the mask 102 may have padding in some embodiments. The mask 102 may extend from the forehead portion 114 and chin portion 116 toward the tip 108.

The mask 102 may generally have a lens portion 120. The lens portion 120 may be transparent or partially transparent, or may include a transparent or partially transparent portion, such that the wearer can see through the lens. In some embodiments, the lens 120 may be generally enclosed, but in other embodiment, may have one or more openings 107, such as an opening at the tip 108, and/or one or more ventilation or sound openings positioned at any of one or more suitable locations on the mask, depending on purpose. The lens 120 may be constructed of one or more plastics or polymers, such as a polycarbonate. The lens 120 may have any suitable thickness. The lens 120 may be constructed using injection molding, vacuum or blow forming, or any other suitable process(es).

Figure 3:
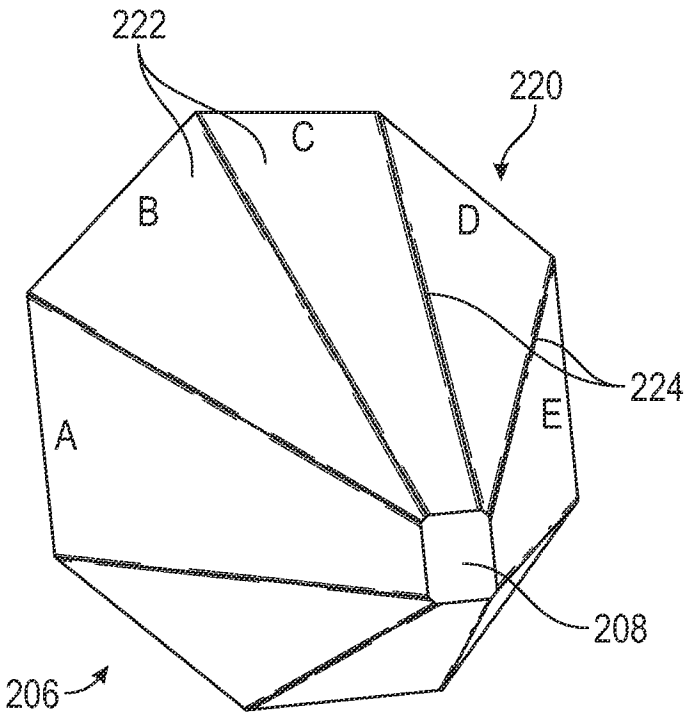
FIG. 3 is a perspective view of a mask lens of the present disclosure, according to one or more embodiments.
Figure 4:
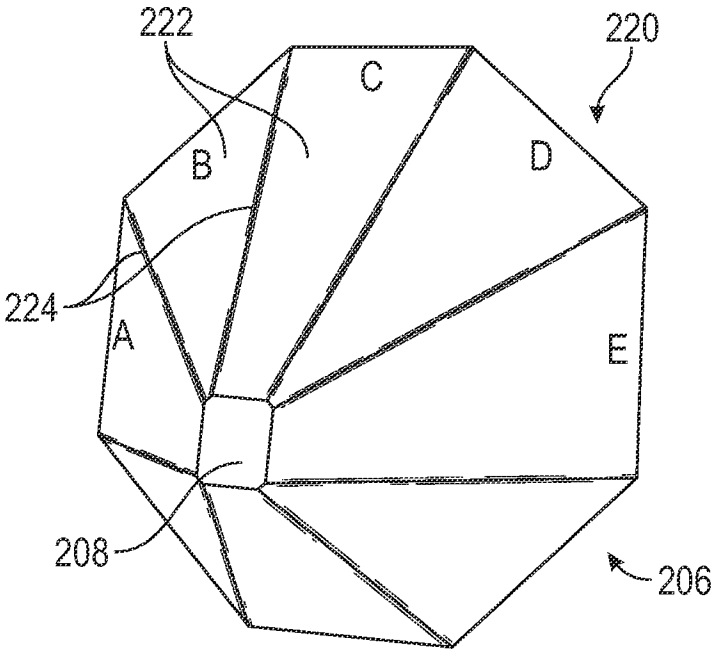
FIG. 4 is another perspective view of the mask lens of FIG. 3, according to one or more embodiments.
Figure 5:
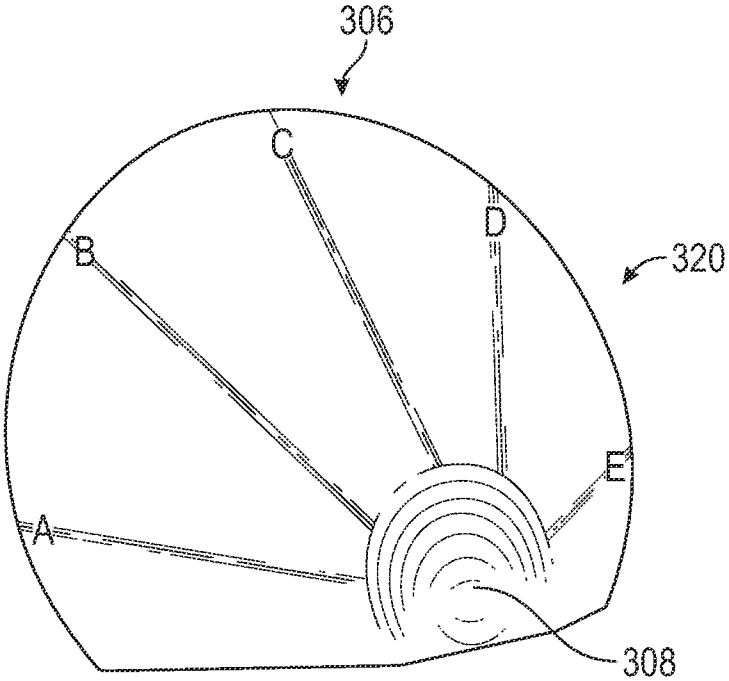
FIG. 5 is a perspective view of a mask lens of the present disclosure, according to one or more embodiments.
Figure 6:
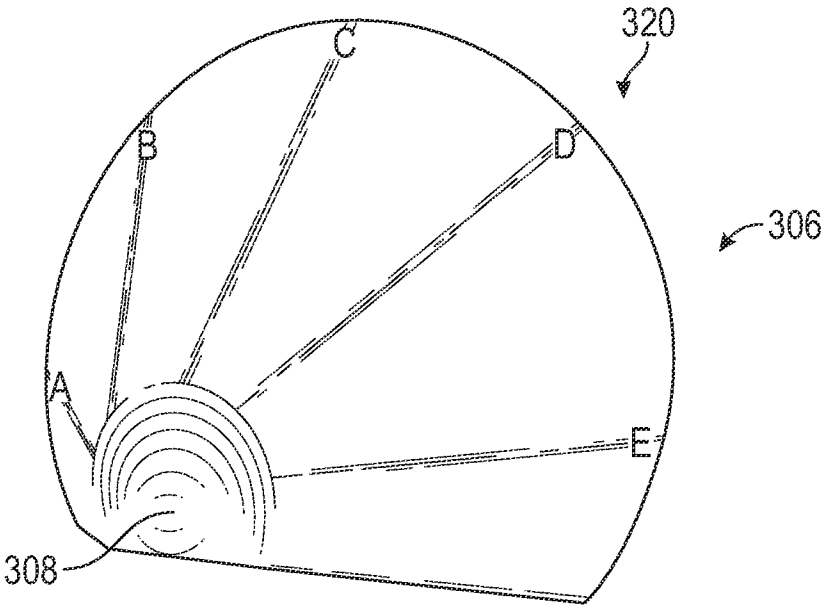
FIG. 6 is another perspective view of the mask lens of FIG. 5, according to one or more embodiments.

In some embodiments, the lens may have a plurality of sectors joined together at a plurality of seams, as shown for example in FIGS. 3 and 4. FIGS. 3 and 4 show a lens 220, wherein each sector 222 may extend between the opening 206 of the mask, or the widest part of the generally conical shape, to the tip 208 of the mask, or the narrowest part of the generally conical shape. Each sector 222 may have a trapezoidal or triangular shape, for example. Adjacent sectors 222 may be joined by a seam 224 at an angle to form the overall cone shape of the lens 220. In some embodiments, a lens 220 may have eight sectors, as shown in FIGS. 3 and 4. In other embodiments, a mask 220 may have more or fewer sectors. In other embodiments, a seamless lens may be provided, as shown for example in the embodiment 320 of FIGS. 5 and 6. That is, in some embodiments, the shape of the lens may be provided by a single piece of plastic or polymer.

As indicated above and shown in FIG. 1, for example, the lens 120 may form all, substantially all, or a majority of the mask 102. In some embodiments, the lens 120 may provide the cone shape of the mask 102, providing the opening 106 for the wearer's face, the tip 108 in front of the wearer's face, and the cone-shaped surface extending therebetween. In some embodiments, in addition to the lens 120, the mask 102 may have a cage portion, as shown for example in FIG. 2.

Figure 2:
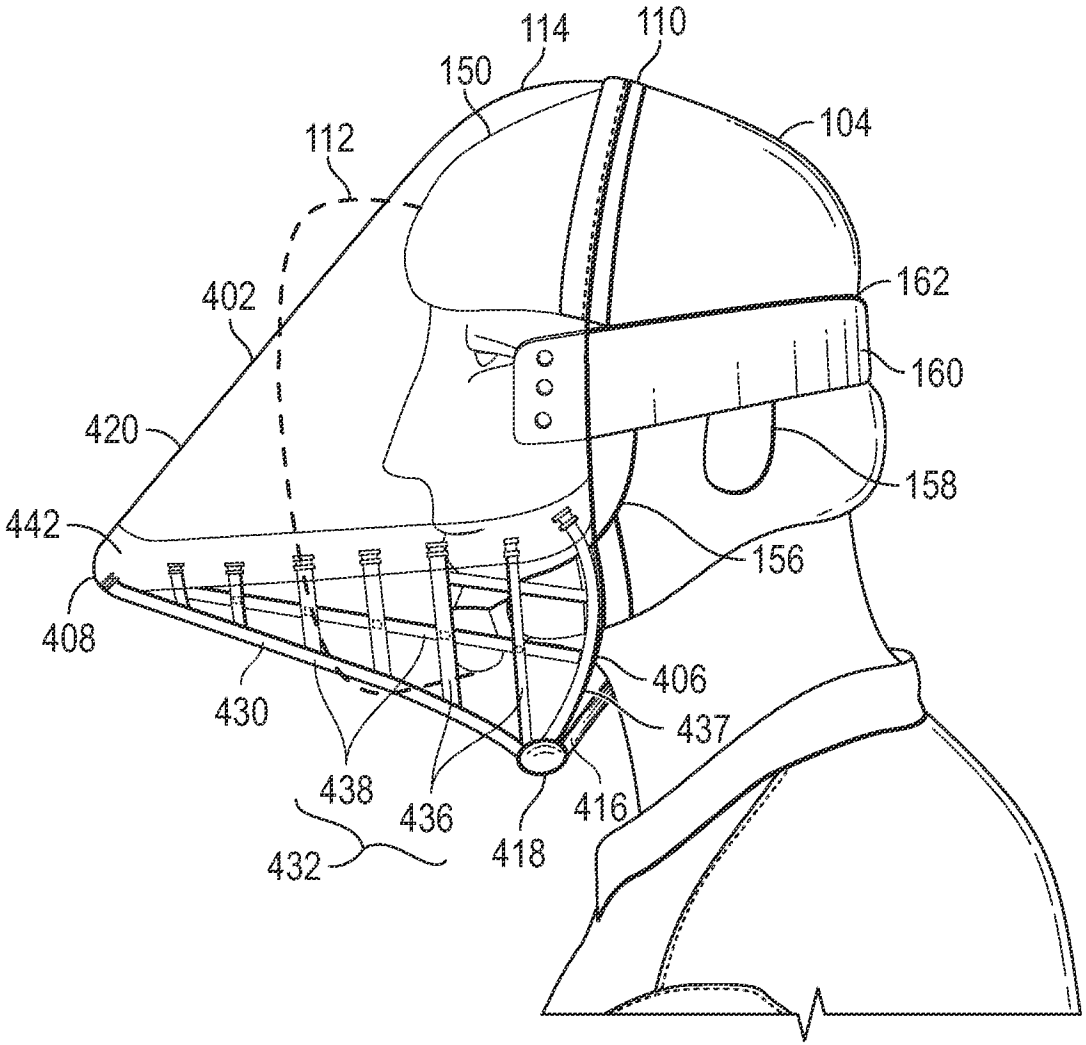
FIG. 2 is a side view of a mask and helmet of the present disclosure, according to one or more embodiments.

FIG. 2 illustrates a mask 402 having a lens portion 420 and a cage portion 430. The cage portion 430 may have a plurality of bars or rods 432 arranged in a pattern, such as a grid pattern. In some embodiments, the cage portion 430 may be arranged on a lower portion of the mask 402. For example, the cage portion 430 may form a lower portion of the cone shape, and may extend between the opening 406 and the tip 408 of the mask 402. The cage portion 430 may be shaped and configured to contour around the wearer's chin, and thus may have a chin portion 416 and padding 418, as described above. From the chin portion 416, the cage portion 430 may extend at an angle toward the tip 408 of the cone shape. In some embodiments, the cage portion 430 may comprise between approximately 30% and 50% of the mask 402. For example, the cage portion 430 may comprise a lower 40% of the mask 402 in some embodiments. The bars or rods 432 forming the cage portion 430 may have a round, square, or rectangular cross sectional shape in some embodiments, and may have any suitable diameter or width. The openings formed by the grid pattern may have any suitable size configured to prevent a baseball, softball, hockey puck, or other device from penetrating the cage 430. The bars or rods 432 may comprise one or more metals, such as aluminum, aluminum alloy, or other suitable metals. In other embodiments, the bars or rods 432 may comprise one or more plastics or other relatively rigid materials. In still other embodiments, the cage portion 430 may comprise a flexible material, such as a woven fabric or other textile.

The bars or rods 432 of the cage portion 430 may couple to the lens 420 using any suitable coupling mechanism. In some embodiments, a plurality of rods 436, which may be radial rods, may extend from a first side of the lens 420, at a lower edge, to the lower edge at a second side of the lens. These radial rods 436 extending from the two sides of the lens may form a lower portion of the cone shape of the mask 402, and may thus have an arced or rounded shape. In this way, the radial rods 436 may have varied lengths, with a shortest rod arranged nearest the tip 408 of the mask 402. A radial rod 436 arranged nearest the opening 406 of the mask 402 may be a longest radial rod. Another rod 437 may define the chin portion 416 of the mask 402, and may be shaped and contoured to accommodate a wearer's chin and neck. A plurality of rods 438, which may be longitudinal rods, may extend generally perpendicular to the radial rods 436 to form a grid pattern. That is, the longitudinal rods 438 may extend across the radial rods 436 and generally between the opening 406 and the tip 408 of the mask 402. The radial 436 and longitudinal 438 rods may be coupled together by welding, fasteners, or any other suitable coupling methods.

Figure 7:
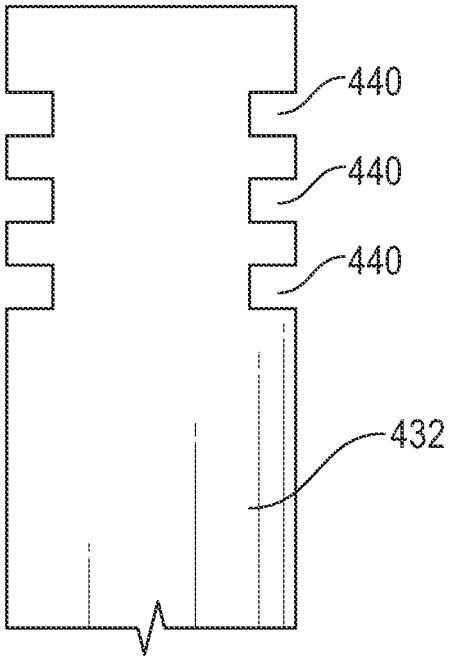
FIG. 7 is a detail side view of a cage portion rod, according to one or more embodiments.

In some embodiments, the cage portion 430 may couple to the lens 420 by infusion into the plastics(s) or polymer(s). One or more bars or rods 432 of the cage portion 430 that connect to the lens 420 may have one or more dados 440 or notches to help facilitate a strong infusion strength, as shown for example in FIG. 7. In some embodiments, the lens 420 may have a thickened portion 442 or band at the interface between the lens 420 and the cage portion 430. The thickened portion 442 may comprise one or more plastics or polymers having a greater thickness than remaining portions of the lens 420, for example. The thickened portion 442 may help to ensure a secure connection between the lens 420 and the cage portion 430. In other embodiments, the cage portion 430 may connect to the lens 420 using other suitable mechanisms, such as but not limited to, snaps, clips, friction fit, screws, or bolts. In some embodiments, the cage portion 430 may be removably coupled to the lens 420, such that it may be readily removable by a wearer. In other embodiments, however, the cage portion 430 may be fixedly or permanently coupled to the lens 420.

The lens 420 may have antireflective and/or anti-fog coating on an inner or outer surface, in some embodiments, the lens 420 or another portion of the mask 402 may have a sound, heat, and/or moisture damper. The damper may include a curved or angled surface arranged on an inner surface of the lens 420 or mask 402, shaped and configured to direct a wearer's voice and/or breath through an opening in the mask. For example, the damper may direct voice and/or breath toward the cage portion 430. In some embodiments, the damper may provide added stability to the lens 420. Additionally, in some embodiments, the lens 420 or another portion of the mask 402 may have one or more venting holes. For example, one or more venting holes may be arranged near each of the wearer's temples. A plurality of venting holes may be arranged in a pattern, such as a honeycomb pattern.

With reference back to FIG. 1, the helmet 104 may generally be configured to cover the top, back, and sides of the wearer's head. The helmet 104 may generally be shaped and contoured to accommodate the shape of a wearer's head. In some embodiments, the helmet may have a forehead portion 150 configured to extend over or across at least a portion of the wearer's forehead. Additionally, the helmet 104 may extend down and around the sides and back of the wearer's head, and over or around the wearer's ears. In some embodiments, the helmet 104 may extend down to, or to a point near, the back and sides of the wearer's neck. The helmet 104 may have a jawline portion 152 extending over the sides of the wearer's jaw line. In some embodiments, the helmet 104 may have a chin strap 154 configured to extend over a wearer's chin. The chin strap 154 may be removable or partially removable from the helmet 104. The helmet 104 may have an opening 156, such as between the forehead portion 150 and the chin portion 154, through which the wearer may position his or her face. Additionally, the helmet 104 may have one or more openings 158 configured to be arranged at or near each of the wearer's ears. For example, one or more openings 158 may be configured to be arranged adjacent the wearer's ears, such that the wearer may be able to hear through the helmet 104. The helmet 104 may be constructed of plastic, polycarbonate, fiberglass, Kevlar, or one or more metals, such as aluminum. In some embodiments, the helmet 104 may have inner padding and/or contouring for a more comfortable fit. In some embodiments, the helmet 104 may have inner padding, such as an expanded polystyrene or polypropylene foam, and/or an air bladder to provide for a comfortable fit for different wearers.

Figure 8:
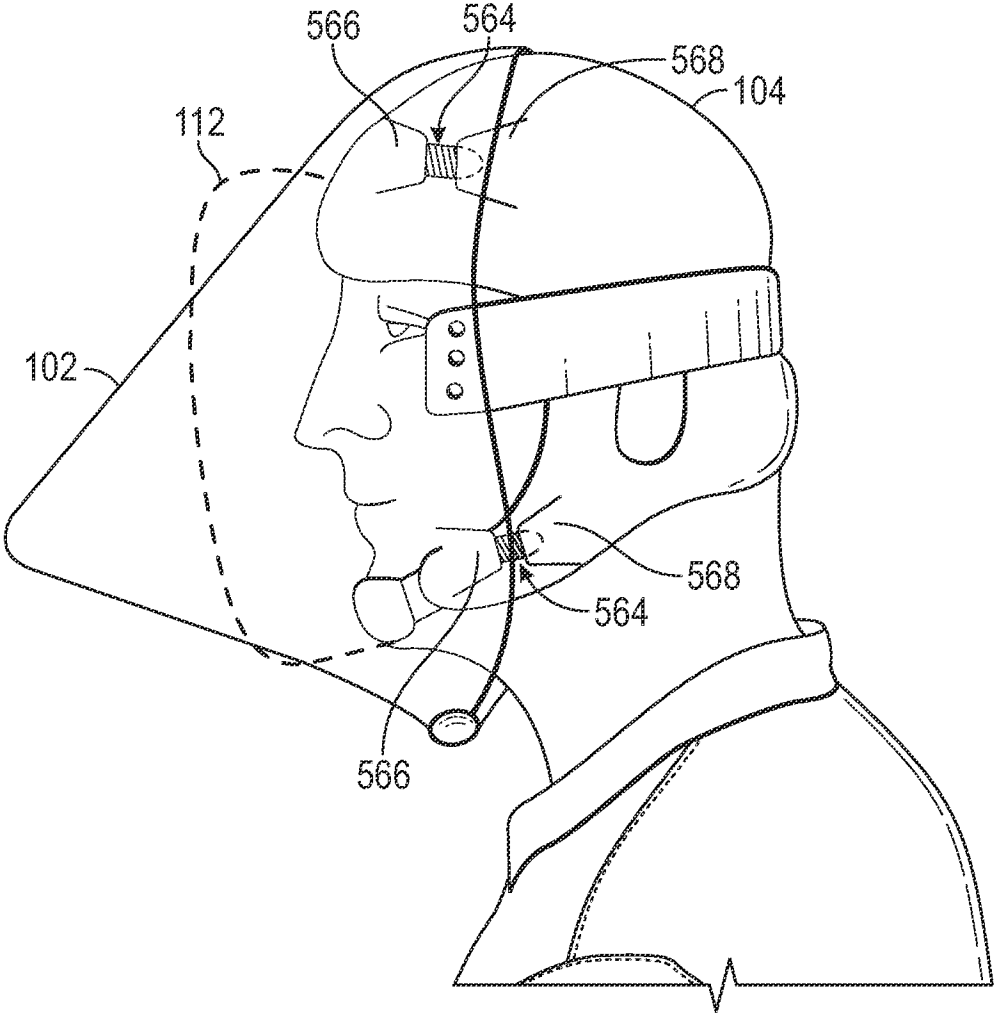
FIG. 8 is a side view of a mask and helmet of the present disclosure, according to one or more embodiments.
Figure 9:
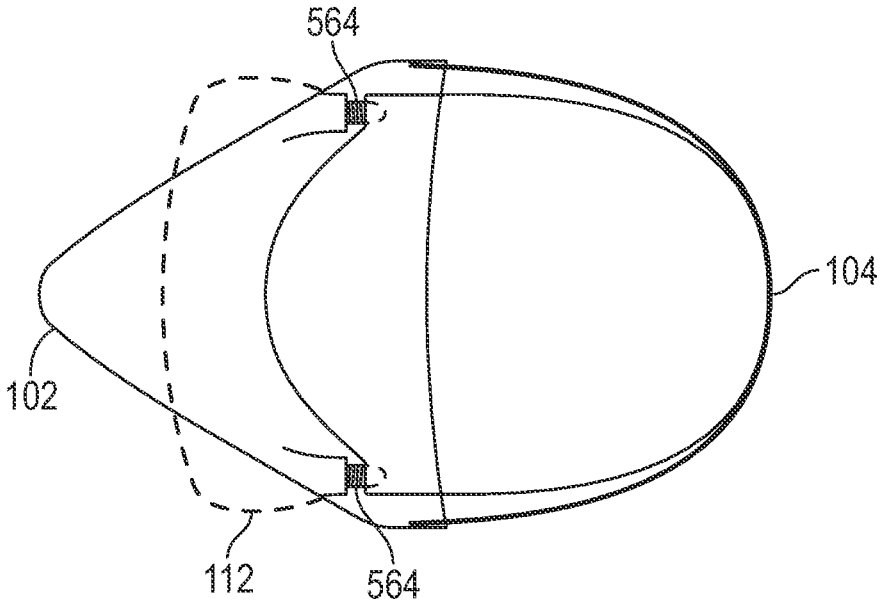
FIG. 9 is a top view of the mask and helmet of FIG. 8, according to one or more embodiments.

With continued reference to FIG. 1, the mask 102 may couple to the helmet 104 using one or more mechanisms. In some embodiments, a strap or band 160, such as an elastic strap, may couple to the mask 102 at each of two sides of the opening 106, and may be configured to wrap around the back of the helmet 104. The helmet 104 may have a groove 162 configured to receive and position the strap 160. In some embodiments, a plurality of straps 160 may be used to couple the mask 102 to the helmet 104. Additionally or alternatively, one or more latches, clips, or snaps 564 may be used to couple the mask to the helmet, as shown for example in FIGS. 8 and 9. For example, the mask 102 may have two, three, four, or any other suitable number of latch portions 566 configured to engage with corresponding latch portions 568 suitably arranged on the helmet 104. The latches or snaps 564 may engage via friction fit, tongue and groove, snap fit, spring tension, buckle, hook and loop, and/or any other suitable mechanisms. The strap(s), latches, snaps, or other attachment mechanisms may position the mask 102 such that the mask covers or wraps around a portion of the helmet 104. For example, the forehead portion 150 and chin strap 154 of the helmet 104 may be positioned generally within the mask 102 when the two components are coupled together.

In some embodiments, a shock absorption component may be provided on the helmet 104 and/or mask 102 to absorb and/or distribute energy from a ball strike. As shown in FIG. 1, for example, a shock absorbing material 110 may be provided at an interface between the mask 102 and the helmet 104. The shock absorbing material 110 may include a strip of silicon rubber or other suitable shock absorbing material(s). The shock absorbing material 110 may extend along an outer surface of the helmet 104 where an edge of the mask 102 meets the helmet, such as at the opening 106 of the mask. In this way, as shown in FIG. 1, the shock absorbing material 110 may extend from one side of the helmet 104 near the wearer's jaw, and extend over an upper portion of the helmet and down to an opposing side of the helmet near the wearer's jaw. As additionally shown, the shock absorbing material 110 may have one or more breaks corresponding to one or more openings 156 in the helmet 104. In other embodiments, the shock absorbing material 110 may be provided at discrete locations along the edge of the mask 102, or at other locations. In such embodiments, at each discrete location, the shock absorbing material 110 may have any suitable length along the edge of the mask 102.

Figure 10:
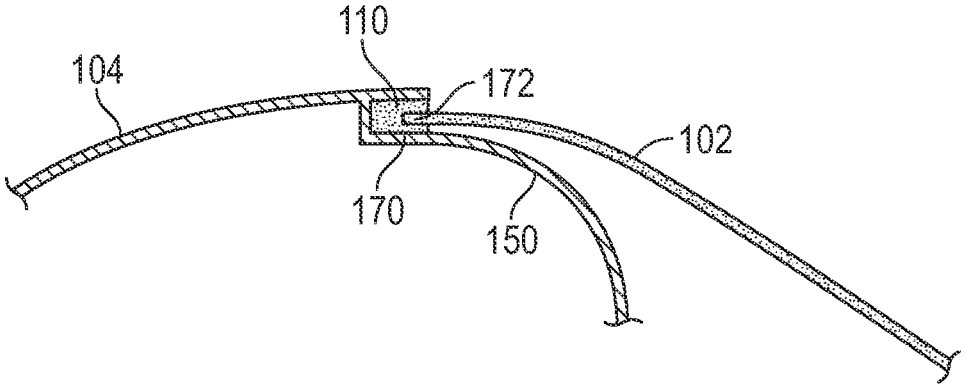
FIG. 10 is a detail view of shock absorbing material at an interface between a mask and helmet, according to one or more embodiments.

As shown in FIG. 10, in some embodiments, the helmet 104 may define a channel 170 in which the shock absorbing material 110 may be arranged. The channel 170 may be continuous around an outer surface of the helmet 104, or may have one or more breaks or gaps. In other embodiments, however, the shock absorbing material 110 may be provided as a strip of material affixed to an outer surface of the helmet. The shock absorbing material 110 may be configured to receive an edge of the mask 102, such as an edge defining the opening 106 of the mask. The shock absorbing material 110 may have a groove 172 configured to receive the edge of the mask 102, such that the mask may be securely positioned within or against the shock absorbing material.

In some embodiments, the mask 102 may be easily removable from the helmet 104, such that a wearer may remove and recouple the mask as needed or desired. For example, the elastic strap 160 may allow a wearer to pull the mask 102 away from the helmet 104 to disengage the mask from the shock absorbing material 110. The wearer may then lift the mask 102 up and off of the helmet 104. In other embodiments, the mask 102 may be removed or partially removed using other suitable methods. In still other embodiments, the mask 102 may be coupled permanently or semi-permanently to the helmet 104.

Figure 11:
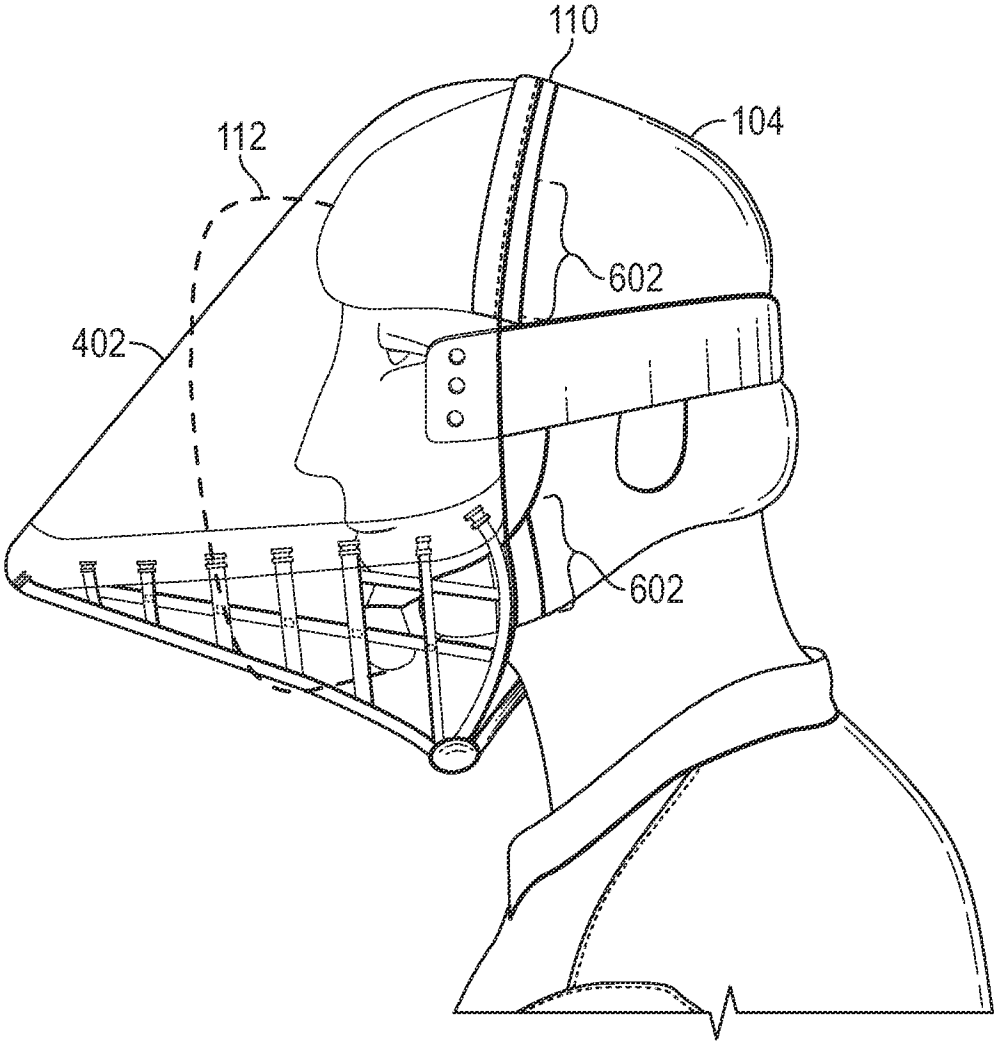
FIG. 11 is a side view of a mask and helmet of the present disclosure, according to one or more embodiments.
Figure 12:
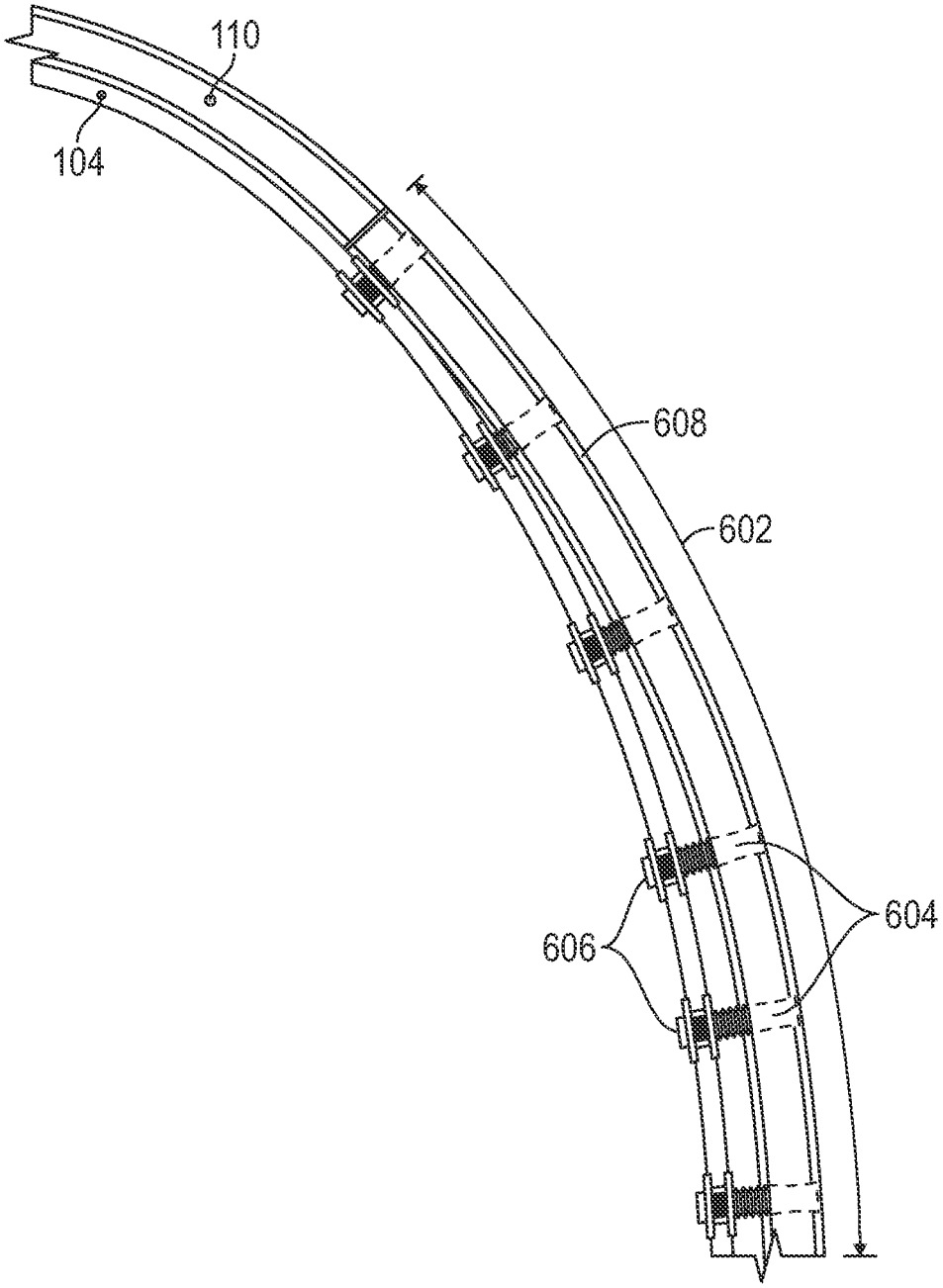
FIG. 12 is a front view of an adjustable interface between a mask and helmet of the present disclosure, according to one or more embodiments.
Figure 13:
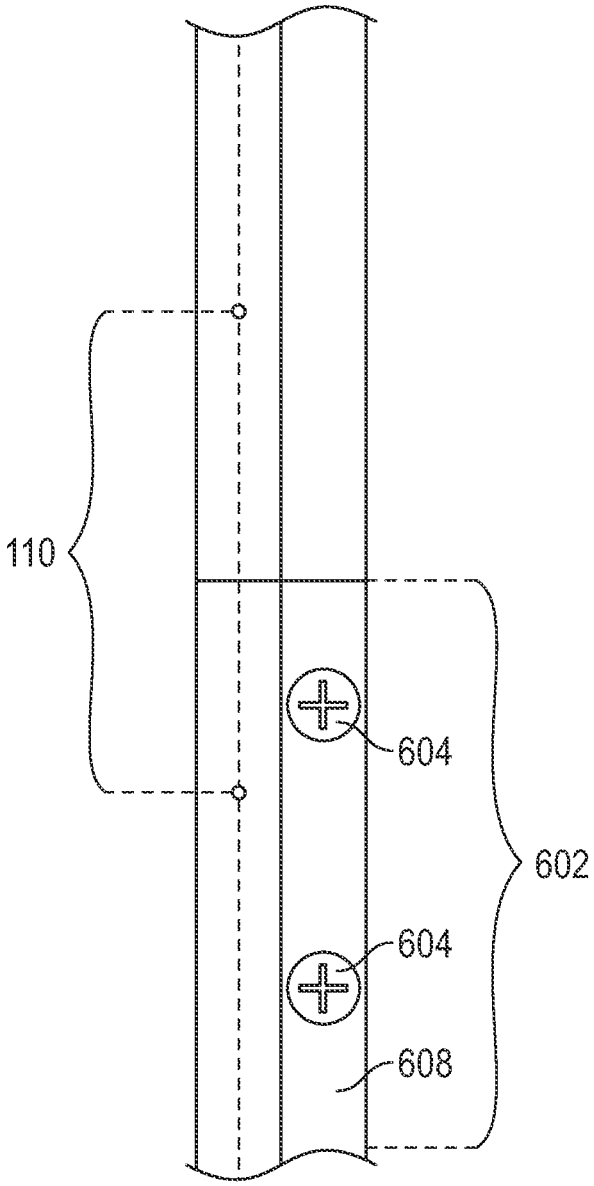
FIG. 13 is a side view of an adjustable interface between a mask and helmet of the present disclosure, according to one or more embodiments.

The interface between the mask and helmet may be adjustable in some embodiments, so as to accommodate variation in wearers' head or face shapes or sizes. In some embodiments, one or more portions or areas of the mask/helmet interface may be adjustable. For example, as shown in FIG. 11, one or more adjustment zones 602 may be provided at suitable locations along the helmet/mask interface. An adjustment zone 602 may include one or more screws, bolts, or other adjustment mechanisms for adjusting a distance between the helmet 104 and mask 402, or otherwise adjusting the connection between the two components. In some embodiments, a channel or other portion of the helmet 104 configured to receive an edge of the mask 402 may be configured to be adjustable. In some embodiments, the shock absorbing material 110 configured to receive the mask 402, or a channel containing the shock absorbing material, may be adjustable. Turning for example to FIG. 12, one or more threaded adjustment screws 604 may be arranged at or near the interface between the shock absorbing material 110, or a channel containing the shock absorbing material, and the helmet 104. As shown in FIG. 13, the adjustment screws 604 may be arranged through a channel 608, or other component of the helmet 104, comprising the shock absorbing material 110. Each adjustment screw may be configured to thread into a blind nut, or in some embodiments a double blind nut, 606. Each blind nut 606 may be anchored in the helmet 104, and may have internal threading configured to engage external threading of an adjustment screw 604. As an adjustment screw 604 is rotated in a first direction, the screw may extend further into the nut 606, and the shock absorbing material 110 may be pulled closer to the helmet 104. As an adjustment screw 604 is rotated in a second direction, the screw may withdraw further out of the nut 606, and the shock absorbing material 110 may be positioned further away from the helmet 104 surface. In this way, the adjustment screws 604 may be used to introduce a gap of variable width between the shock absorbing material 110 and the helmet 104 surface, such that a gap may be introduced between the mask 402 and the helmet 104.

Figure 14:
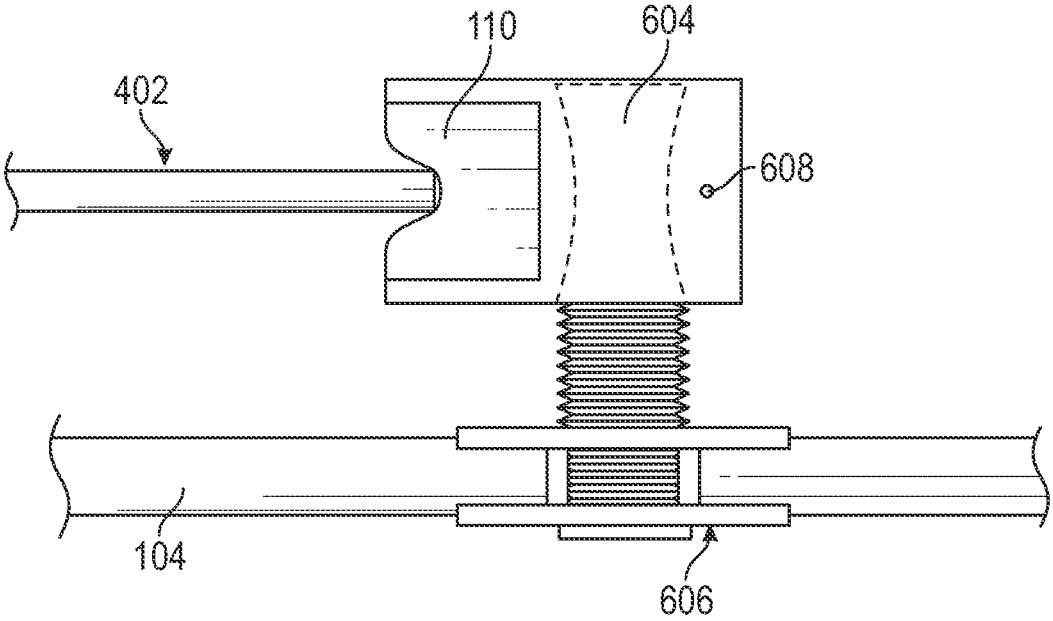
FIG. 14 is a front detail view of an adjustable interface between a mask and helmet of the present disclosure, according to one or more embodiments.

Turning for example to FIG. 14, an adjustment screw 604 is shown extending through a channel 608 containing shock absorbing material 110. As shown, the channel 608 and shock absorbing material 110 may be configured to receive an edge of the mask 402. Adjustment of the adjustment screw 604 may increase or decrease a gap between an outer wall of the helmet 104 and an inner wall of the mask 402. In this way, the adjustment screws 604 may be adjusted to pull the mask 402 closer to the helmet 104, or to extend the mask further away from the helmet. Each adjustment screw 604 may be adjusted differently for a customized fit. In this way, by widening or reducing the gap differently at different adjustment screw 604 locations, different portions of the mask 402 may be positioned differently with respect to the helmet 104.

In each adjustment zone 602, any suitable number of adjustment screws 604 and corresponding blind nuts 606 may be arranged to allow for adjustment between the shock absorbing material 110 and helmet 104. In some embodiments, an adjustment zone 602 may include all or substantially all of the interface between the mask 402 and the helmet 104. In other embodiments, adjustment zones 602 may be arranged generally on the sides of the helmet 104, such that adjustments may be made near left and right sides of a wearer's face or head, as shown in FIG. 11. Other portions of the mask/helmet interface may be non-adjustable, with a fixed distance between the outer wall of the helmet 104 and inner wall of the mask 402.

In other embodiments, other suitable mechanisms may be used to widen or reduce a gap between the mask and helmet, or otherwise adjust an interface between the helmet and mask. Additionally or alternatively, in some embodiments, other portions of the mask and/or helmet may be adjustable. For example, the chin portion of the helmet may be adjustable to varying lengths, or the elastic strap of the mask may be adjustable to fit different helmets. In some embodiments, a helmet may be configured to fit a variety of masks. For example, a variety of masks having different tints for different weather conditions or times of day may be interchangeable. In some embodiments, masks and/or lenses may be provided with differing sizes to fit a variety of wearers. For example, helmets and/or masks may be provided in one or more youth sizes and one or more adult sizes.

In use, a mask and/or helmet of the present disclosure may help to protect a wearer's head and face from potential injury-causing events. For example, a baseball or softball catcher may wear the mask and helmet to mitigate injury from ball strikes. A mask and/or helmet of the present disclosure may provide improvements over conventional athletic equipment by better protecting the wearer.

The angled cone shape of the mask may deflect balls or other objects. For example, as a ball travels horizontally toward the mask, the angled surface of the mask may deflect a portion of the ball's energy. That is, because the surface of the mask may be angled to the ball's trajectory, rather than perpendicular or nearly perpendicular to the ball's trajectory, the ball may strike the mask with less than its full force. In this way, the ball may transfer less energy to the angled surface of the mask, than it would a more flattened or vertical surface of a conventional athletic mask. Looking for example at FIG. 1, the outline of a conventional mask illustrates a relatively vertical mask surface. A horizontal ball trajectory traveling toward the mask may transfer all or substantially all of its energy into the surface of the mask. In contrast, a horizontal ball trajectory traveling toward the cone-shaped mask of the present disclosure may transfer a smaller portion of its energy into the surface of the mask upon encountering the angled surface.

Additionally, the shock absorbing strip may help to reduce, as well as transfer, energy from a ball strike or other potential injury causing event. If a ball strikes the mask, causing movement or vibration of the mask, the shock absorbing material arranged at an edge of the mask may dampen at least some of the vibration or movement caused by the ball strike. Additionally, in some embodiments, the shock absorbing material may transfer the energy from the mask to the helmet. Moreover, the shock absorbing material may allow energy to be distributed along the interface between the mask and the helmet. That is, the shock absorbing material may allow energy from a ball strike on the mask, for example, to be distributed to the helmet through the shock absorbing material, wherever the shock absorbing material is arranged. This may allow a force, including a concussive force to the mask, to be transferred throughout the helmet. This may provide for more even force distribution over conventional masks and/or helmets.

In some embodiments, a mask of the present disclosure may operate to reduce or modify whipping action that can occur as a result of a ball strike or other event. For example, a ball strike to an individual's forehead may tend to cause the individual's head to tilt back about the base of the neck, resulting in a whipping action. The base of the neck typically operates as a fulcrum as the head is thrown back from the force. A mask of the present disclosure may operate to reduce the lever arm of such whipping action by providing an angled surface for potential ball strikes. Looking for example at FIG. 1, the outline of a conventional mask shows that a ball strike near the forehead of the wearer would create a lever arm extending between the wearer's forehead and the base of the wearer's neck. In contrast, the angled surface of the mask 300 may direct the ball's energy to be focused closer to the wearer's nose, or closer to the tip of the mask, thus reducing the lever arm of the resulting whipping action. This may reduce torque of the resulting whipping action and ultimately may reduce the potential for a concussive event.

In addition to the advantages described above with respect to protection and injury prevention, a mask of the present disclosure may provide for improved visibility. That is, the transparent lens of the mask may allow a wearer to exercise a full or relatively unobstructed range of vision through the mask. This is an improvement over conventional masks. Moreover, the cone shape of the mask may be provided at an angle so as to avoid or reduce interference with a batter's swing. As may be appreciated from FIG. 1, for example, the angled surface of the mask 102 may have a lower profile in some areas than a conventional mask 112. As a baseball or softball catcher crouches behind a batter, the mask may remain outside of the arc of the batter's swing of the bat. In this way, the lower profile of the angled surface of the mask may reduce interference with a batter's swing, providing an improvement over conventional masks.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. An athletic mask comprising:

a lens portion comprising a seamless curved sidewall forming an at least partially conical shape extending between an edge of the sidewall at least partly defining a first opening dimensioned to fit around a face of a wearer of the mask and a tip configured to be positioned between approximately 5 and 15 inches in front of the face of the wearer, and horizontally aligned with a point on the face of the wearer between a nose and a chin of the wearer, when the mask is worn by the wearer; and a strap extending from a first side of the mask to a second side of the mask and configured to extend around a back of the head of the wearer to maintain the mask on the wearer with the first opening positioned around the face of the wearer.

2. The athletic mask of claim 1, wherein the first opening has a first diameter, and a cross-sectional diameter of the sidewall decreases from the first diameter as the sidewall extends to the tip.

3. The athletic mask of claim 2, wherein the tip comprises a second opening having a second diameter smaller than the first diameter.

4. The athletic mask of claim 1, wherein the strap comprises an elastic strap coupled with the lens portion at the first and second sides of the mask.

5. The athletic mask of claim 1, wherein the sidewall is at least partially transparent.

6. The athletic mask of claim 5, wherein the sidewall comprises a polycarbonate material.

7. The athletic mask of claim 1, further comprising a cage portion operably coupled with the lens portion, an edge of the cage portion at least partly defining the first opening.

8. The athletic mask of claim 7, wherein the cage portion comprises a grid pattern of at least one of metal bars, plastic bars, or flexible material.

9. The athletic mask of claim 1, wherein at least a portion of the edge of the sidewall comprises at least one of padding or a shock absorbing material.

10. The athletic mask of claim 1, further comprising at least one second opening through the sidewall for ventilation or sound.

11. The athletic mask of claim 1, wherein the lens portion comprises at least one of an antireflective or anti-fog coating.

12. An athletic mask comprising:

a lens portion comprising a sidewall extending between an edge of the sidewall at least partly defining a first opening dimensioned to fit around a face of a wearer of the mask and a tip configured to be positioned between approximately 5 and 15 inches in front of the face of the wearer, and horizontally aligned with a point on the face of the wearer between a nose and a chin of the wearer, when the mask is worn by the wearer, wherein the first opening has a first diameter, and a cross-sectional diameter of the sidewall decreases from the first diameter as the sidewall extends to the tip; and a strap extending from a first side of the mask to a second side of the mask and configured to extend around a back of the head of the wearer to maintain the mask on the wearer with the opening positioned around the face of the wearer.

13. The athletic mask of claim 12, wherein the tip comprises a second opening having a second diameter smaller than the first diameter.

14. The athletic mask of claim 12, wherein the strap comprises an elastic strap coupled with the lens portion at the first and second sides of the mask.

15. The athletic mask of claim 12, wherein the sidewall is at least partially transparent.

16. The athletic mask of claim 15, wherein the sidewall is comprised of at least one of a plurality of generally triangular or generally trapezoidal sectors.

17. The athletic mask of claim 12, further comprising a cage portion operably coupled with the lens portion, an edge of the cage portion at least partly defining the first opening.

18. The athletic mask of claim 12, further comprising at least one second opening through the sidewall for ventilation or sound.

19. The athletic mask of claim 12, wherein the lens portion comprises at least one of an antireflective or anti-fog coating.

20. The athletic mask of claim 12, wherein the sidewall comprises a forehead portion configured to extend over a forehead of the wearer when the mask is worn by the wearer and a chin portion configured to extend below the chin of the wearer when the mask is worn by the wearer.

* * * * *